United States Patent [19]

Lafayette, Jr.

[11] Patent Number: 4,765,112

[45] Date of Patent: Aug. 23, 1988

[54] APPARATUS AND METHOD FOR MOUNTING STONE SIDING

[75] Inventor: Maurice Lafayette, Jr., Danville, Calif.

[73] Assignee: Lafayette Manufacturing, Inc., Hayward, Calif.

[21] Appl. No.: 23,769

[22] Filed: May 7, 1987

Related U.S. Application Data

[63] Continuation of Ser. No. 805,161, Dec. 4, 1985, abandoned.

[51] Int. Cl.[4] ..... E04B 1/38

[52] U.S. Cl. ..... 52/511; 52/235; 52/506

[58] Field of Search ..... 52/235, 511, 512, 513, 52/509

[56] References Cited

U.S. PATENT DOCUMENTS

| | | | |
|---|---|---|---|
| 741,043 | 10/1903 | Kann | 52/513 |
| 1,728,231 | 9/1929 | Denk | 52/509 |
| 2,073,130 | 3/1937 | Wallace | 52/513 |
| 2,880,472 | 4/1959 | Kublanow | 52/513 |
| 3,140,565 | 7/1964 | Ward, Jr. | 52/511 |
| 3,299,601 | 1/1967 | Chiville | 52/513 |
| 3,605,366 | 9/1971 | Bafein | 52/513 |
| 4,510,727 | 4/1985 | Jury | 52/511 |
| 4,531,338 | 7/1985 | Donatt | 52/235 |

FOREIGN PATENT DOCUMENTS

| | | | |
|---|---|---|---|
| 135563 | 7/1933 | Australia | 52/513 |
| 106479 | 2/1939 | Australia | 52/513 |
| 643232 | 6/1962 | Canada | 52/511 |
| 15879 | 7/1908 | United Kingdom | 52/513 |
| 551400 | 2/1943 | United Kingdom | 52/509 |

*Primary Examiner*—Carl D. Friedman
*Assistant Examiner*—Michael Safavi
*Attorney, Agent, or Firm*—Townsend and Townsend

[57] ABSTRACT

Cut natural stone such as marble or granite is provided with spaced apart oppositely inclined circular saw cuts from the interiorly exposed surface to and toward but not through the exterior exposed weather surface. The cuts are made preferably towards one another without relative movement of the saw along the plane of the stone panel so as to leave a circular profile at the bottom of each inclined cut. First and second planar clamp sections are inserted to fit within each cut, the clamp sections having a complementary curved and arcuate profile penetrating the curved and arcuate profile of the saw cut. The clamp sections are each prebent so as to expose elongate back to back mounting sections in juxtaposition disposed generally parallel to the interior surface of the stone. Typically the mounting sections on one clamp portion overlies and is configured for welding to the mounting portion of the other clamp section. Such configuration can include one mounting section being narrower than the other mounting section for a butt weld or one mounting section provided with holes for a plug weld. When the sections are fastened, the clamp is locked to the stone. A process of constructing a natural stone curtain wall is disclosed in which natural stone panels are placed in their desired spaced apart relationship, typically in a jig. Clamps are mounted as desired in accordance with this invention and thereafter a supporting frame lowered and braced in spaced apart relation above the stone panel and attached clamps. Connections between the elongate clamp backs and the frame are made so that when the frame is lifted free, the exterior weather surface of the stone is supported from the frame.

4 Claims, 3 Drawing Sheets

APPARATUS AND METHOD FOR MOUNTING STONE SIDING

This is a continuation of application Ser. No. 805,161 filed 12/4/85 and now abandoned.

BACKGROUND OF THE INVENTION

This invention relates to natural stone walls on buildings and more particularly to a clamp for securing natural stone panels to the exterior of a building.

SUMMARY OF THE RELEVANT LITERATURE

The prior art support of natural stone panels (granite or marble) includes drilling angularly inclined holes in the natural stone from the interior surface to and towards but not through the weather surface. Rods are then inserted in the angularly inclined holes as the support points. The rods as inserted, protrude from the holes. It is these protrusions that are used as support points for the natural stone panels.

The utilization of rods for support leads to difficulty. First, the rods provide a small shear cone when forcible removal of the granite panel occurs. That is to say, the portion of the granite that is required to break away around such hole mounted rod is relatively small; consequently rods for adequate support must be closely spaced and relatively numerous.

Support of the rods as mounted to the natural stone panels presents additional problems. Specifically, the rods must be precisely positioned on the stone so that correspondent precise positioning can occur at the building support points.

In order to prevent and compensate for this precise positioning of rods on the stone panel, it has been conventional to first fasten the rods to the stone panel and thereafter to imbed such stone supporting rods in either conventional reinforced concrete or glass fiber reinforced concrete. In both these methods, the embedded rod is placed within a concrete composite which supports the stone veneer to the panel mounted on the building. This method of using concrete is expensive in that additional labor and material is required. Additionally, curing time in the manufacturing facility requires additional dwell time for the panel.

It is also known to provide clamps for mounting natural stone panels at the periphery of such panels. According to this technique, natural stone is provided with a slot "cuff" at its edges. Bent clamps (usually top and bottom, or aluminum or steel angle devices) penetrating the edges brace the natural stone therebetween and hold it to the building sides or panel framework. This method has the disadvantage of requiring a continuous and uninterrupted support of the stone. Not only is the size and shape of stone panel limited, but some difficulty is experienced in caulking the stone joints between adjacent panels.

SUMMARY OF THE INVENTION

Cut natural stone such as marble or granite is provided with spaced apart oppositely inclined circular saw cuts from the interiorly exposed surface to and toward but not through the exterior exposed weather surface. The cuts are made preferably towards one another without relative movement of the saw along the plane of the stone panel so as to leave a circular profile at the bottom of each inclined cut. First and second planar clamp sections are inserted to fit within each cut, the clamp sections having a complementary curved an arcuate profile penetrating the curved and arcuate profile of the saw cut. The clamp sections are each prebent so as to expose elongate back to back mounting sections in juxtaposition disposed generally parallel to the interior surface of the stone. Typically the mounting sections on one clamp portion overlies and is configured for welding to the mounting portion of the other clamp section. Such configuration can include one mounting section being narrower than the other mounting section for a butt weld or one mounting section provided with holes for a plug weld. When the sections are fastened, the clamp is locked to the stone. A process of constructing a natural stone curtain wall is disclosed in which natural stone panels are placed in their desired spaced apart relationship, typically in a jig. Clamps are mounted as desired in accordance with this invention and thereafter a supporting frame lowered and braced in spaced apart relation above the stone panel and attached clamps. Connections between the elongate clamp backs and the frame are made so that when the frame is lifted free, the exterior weather surface of the stone is supported from the frame.

OTHER OBJECTS AND ADVANTAGES

At object of this invention is to disclose a clamp for supporting stone from an interior surface. A circular saw cut is made at an acute angle from the interior stone panel surface to and towards the weather exterior exposed surface. The cut is made with the saw penetrating along the plane of the blade without otherwise relative movement with respect to the plane of the stone panel so as to leave a circularly profiled cut in the natural stone. Thereafter, a clamp having a complementary circular profile is inserted into and penetrates the stone cut. Preferably the clamp is prebent to have a first portion which penetrates to the cut in the stone and a second portion which extends away from the clamp typically parallel to the interior surface of the stone panel.

An advantage of this clamp is that it generates an enlarged shear cone for forcible removal of the stone. Consequently, it securely mounts stone and clamp in a unitary configuration.

A further advantage of the disclosed clamp is that the support point can be generated at any place along the interior side of the stone. It is not required that the stone be supported at its edges and span any distance.

A further object of this invention is to disclose self-locking clamps for placement to stone. Paired clamp members are provided. Each clamp member includes a stone penetrating surface, preferably with an arcuate end, and an elongate horizontally extending back. The stone penetrating surface of the clamp is bent at an angle with respect to the horizontally extending back, this angle preferably being an acute angle. Paired oppositely inclined circular saw cuts are made into the interior surface of stone panel complementary to the shape of the clamp portions. The clamp sections are thereafter inserted within the stones so as to dispose their elongate backing sections in overlapping back-to-back juxtaposition. The elongate backs are thereafter fastened securely one to another, so as to firmly lock the clamp to the stone. Such fastening preferably occurs by butt or plug welding.

An advantage of this clamp is that it is firmly locked to the stone when it is attached. Movement normal to the plane of the saw cuts is resisted by the mass of the clamp. Movement in the plane of the saw cuts is resisted by engagement of the circularly profiled clamp in the complementary circularly profiled saw cut.

A further advantage of the disclosed clamp is that it premits welded attachment. Typically, the elongate backing sections are spaced apart from the stone so that radiated heat of welding cannot appreciably effect the stone underneath. Moreover, the clamp sections each provide an elongate thermal conducting path from the point where they penetrate the stone to the point where the weld occurs. Again, the heat of welding does not reach the stone. Consequently the clamp may be readily welded to stone.

A further advantage of the disclosed clamp is that it exposes a broad metallic support point for direct attachment to a frame. Specifically, a point where welds may be made is provided over a broad surface.

A further object of this invention is to disclose a process of constructing stone section curtain walls. Typically a jig is provided into which stone panel is placed. The stone panel is placed with the weather surface downwardly exposed into the surface of the jig with the interior surface exposed upwardly. Thereafter, an arbor mounted stone saw makes the appropriate oppositely inclined circular saw cuts at the desired locations for clamp support. The clamp sections are inserted with their elongate backs juxtaposed and welded so as to firmly attach the clamps to the stone. Once the clamps are all in place, a frame is lowered and braced from the jig in the desired spaced apart relation from the stone panel. Thereafter, welded connections are made from the clamps to the frames are made. These connections allow for the required flexibility to permit thermal expansion and contraction of both frame and stone in the manufacturing process and in the final position on the building. Thereafter, and once the attachments between the clamp and frame have been made, the frame is lifted taking with it the stone panels in their final support side-by-side position.

An advantage of the disclosed process is that natural stone building panels can be rapidly fabricated in a fabrication site without requirement of waiting for curing such as the curing of either conventional or glass fiber reinforced concrete.

A further aspect of the invention is that with the exception of the stone cutting, all steps required for the wall can consist of welding. Consequently, the curtain walls may be rapidly fabricated.

Other objects, features and advantages of this invention will become more apparent after referring to the following specification and attached drawings in which:

DESCRIPTION OF THE SPECIFIC EMBODIMENTS

Figure 1:
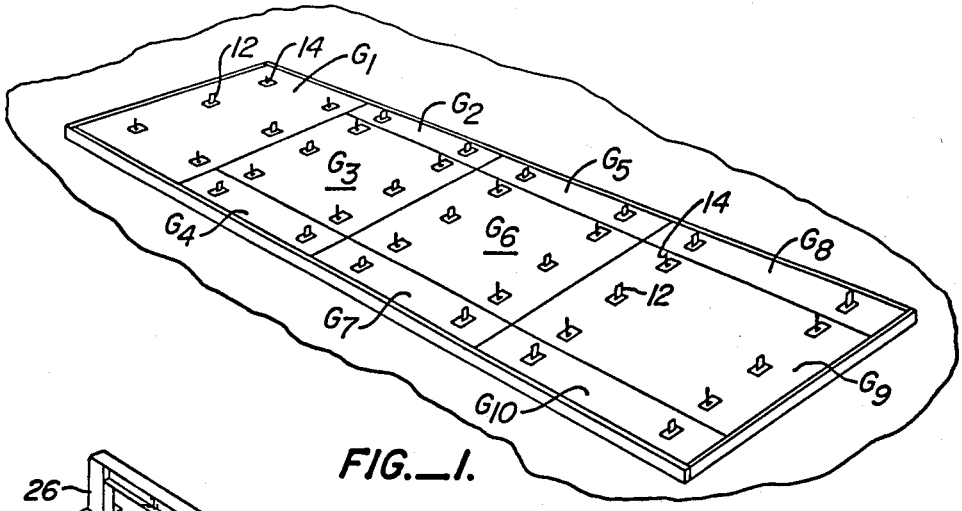
FIG. 1 is a perspective in view of marble panel sections mounted to a jig, the panel sections shown with their finished weather surfaces downwardly exposed and with their interior and typically unfinished mounting surface upwardly exposed.

In FIG. 1 a 20-foot section of granite curtain wall is disclosed in which 10 granite panels, G1–G10, are mounted. The granite is placed in a pattern so as to provide to the exterior surface of a building with a pleasing and esthetic appearance through differing shades of the natural stone. Each panel, G1–G10, is marked with desired shear connection points 12 and lateral connections points 14. It is to these points on the panels that the clamps must be fastened.

Figure 2A:
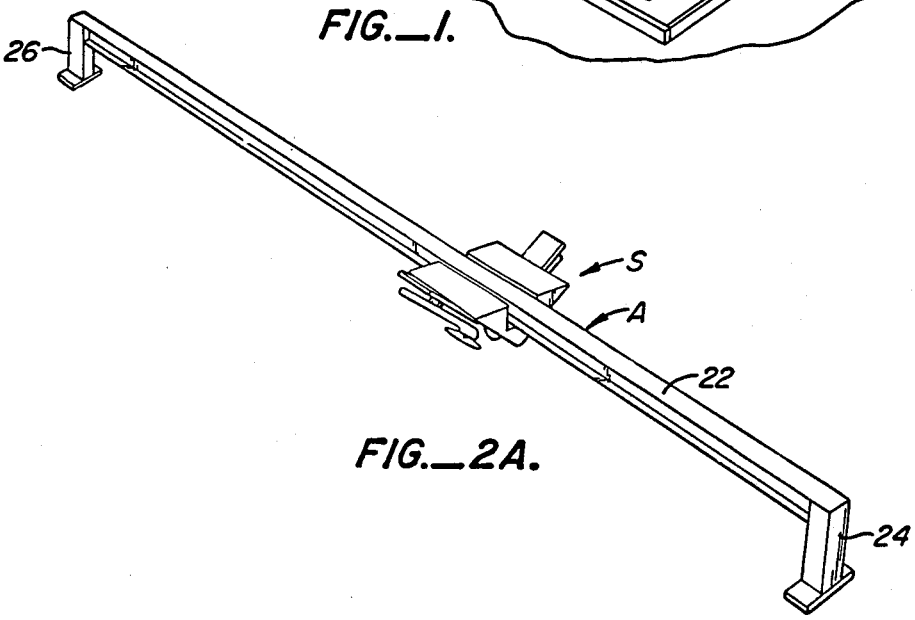
FIG. 2A is a perspective view of two arbor mounted saws each saw being movable along the plane of a blade of penetration into the stone.

Referring to FIG. 2A, the jig of FIG. 1 is shown with an arbor mounted saw disposed thereover. Typically, the arbor A includes an I-beam 22 supported at both ends by beam members 24, 26. The respective saws are mounted upon wheels 30 riding in flangeways 32. Wheels 30 support frame 35. Frame 35 in turn supports oppositely incline saw ramps 40, 42 supporting saws 44, 46. The saws by sliding along the ramps without movement relative to the exposed interior surface of the panel leave arcuate profiled cuts in the panel. A section of such cuts is shown in FIG. 2B.

Figure 2B:
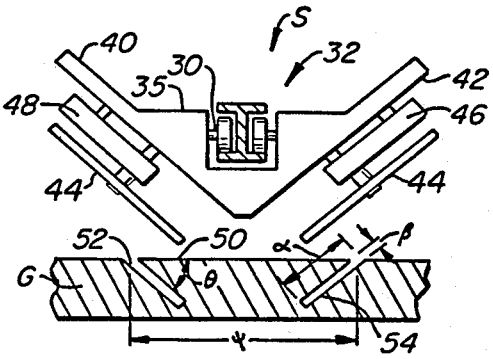
FIG. 2B is a side elevation section taken at the stone illustrating the profile of the slots for the clamp cut into the stone.

Referring to FIG. 2B, each of the slots 52, 54 are spaced a preselected distance apart at the point of saw entry, a distance of 6-inches being preferred. The stone panel is here shown 1¼ inches thick. Here, the respective saw slots are angled to and towards one another each slot defining a 40° angle with respect to the flat plane of the interior surface of the stone. The respective slots are about 1½ inches long. Angles and dimension may vary consistent with the strength and shear characteristics of the stone involved.

It will be appreciated that it may be desired to angle the saw slots away from one another. In any event, the saw slots may be described as oppositely inclined.

The saw slots are made without any relative movement of the circular saws with respect to the plane of the granite. The saws penetrate the granite only along their plane. This being the case it will be appreciated that each of the saw cuts contains a circular sectioned profile along their respective base.

Figure 3A:
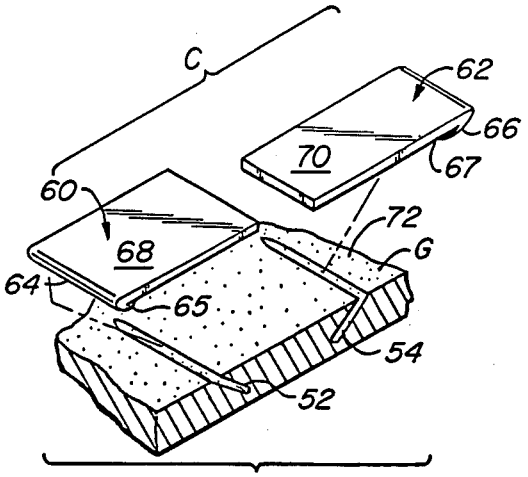
FIG. 3A is a perspective view of the clamp sections of this invention overlying the saw cut of FIG. 2B.

Referring to FIG. 3A, a perspective view of a clamp C in accordance with this invention is shown exploded from and overlying a saw cut according to FIG. 2B.

As can be seen, each clamp consists of two clamp sections 60, 62. Each clamp section includes two active portions. One portion penetrates and fastens to the stone. It is called the clamp portion. The other portion is the back. It serves to fasten the clamp sections together and forms the support surface from which panel support occurs.

A first clamp section 60 and a second clamp section 62 are each illustrated. Clamp section 60 includes clamp portion 64 and back 68. Clamp portion 64 is provided with an arcuate end 65 which is complementary to the arcuate bottom of slots 52, 54. Back 68 is shown bent relative to clamp portion 64. The bend is provided so that back 68 is disposed parallel to the plane of the stone panel 72.

Clamp section 62 is identical construction to clamp section 64. Specifically, clamp section 62 includes clamp portion 66 with an arcuate end 67. Arcuate end 67 penetrates into the slots 52, 54. Back end 70 slightly narrower than back 68 on clamp section 60 is utilized. This narrowed back 70 is used so that when the clamp sections 70 is used 62, 64 are juxtaposed with their backs 68, 70 confronted one to another, convenient welding of narrow back 70 may occur to wide back 68.

Figure 3B:
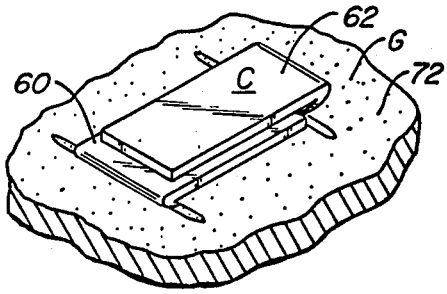
FIG. 3B is a perspective view of the clamp sections inserted in the saw cut of FIG. 2B.

Referring to FIG. 3B, mounting of the clamp to the stone may be easily understood. First, clamp section 60 is penetrated at clamp portion 64 into slot 52 so as to dispose back 68 parallel to the surface 72 of the granite slab G.

Thereafter, clamp section 62 is penetrated at clamp portion 66 into slot 54. It is disposed so that narrow back 70 overlies broad back section 68 on clamp section 60.

It is preferred that back 68 have a minimum clearance from the granite panel in the order of ⅛-inch. It is also preferred to place a metal stone adhesive in the respective slots 52, 54 before insertion of the clamps 60, 62. Typically, epoxy is used.

Figure 3C:
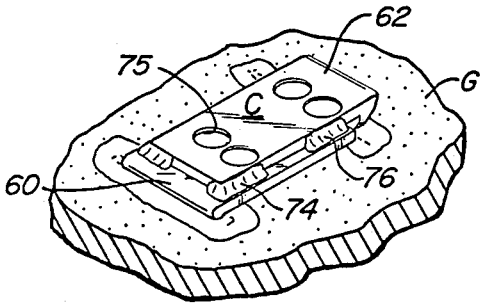
FIG. 3C is a perspective view of the clamp sections being welded so as to bond to stone panel.

FIG. 3C illustrates an alternate welding configuration. Specifically, plate 62 has been provided with a plurality of holes 75 for plug welding. In this configuration backs 68, 62 can have the same width.

Referring to FIG. 3C, once the respective clamp section 60, 62 are in place, their respective backing sections 68, 70 are bonded one to another. Preferred bonding occurs by butt welding along welded seams 74, 76 or plug welds at apertures 75. Once the welding has occurred, it can be seen and understood that the clamp is firmly bonded to the granite panel G. Movement of the panel relative to the clamp can no longer occur.

Regarding such movement normal to the plane of the respective cuts 52, 54, such movement is not possible. Movement is restricted because the cuts 52, 54 and clamp portions 64, 66 are oppositely inclined. It will be apparent to the reader that this will be true whether or not the cuts are inclined towards one another or away from one another. It is preferred that the cuts be inclined to and towards one another.

Secondly, it is not possible for the clamp members to slide along their plane. The complementary shape of the cuts 52, 54 and curvatures of the clamp ends 65, 67 prevent this motion.

Figure 3E:
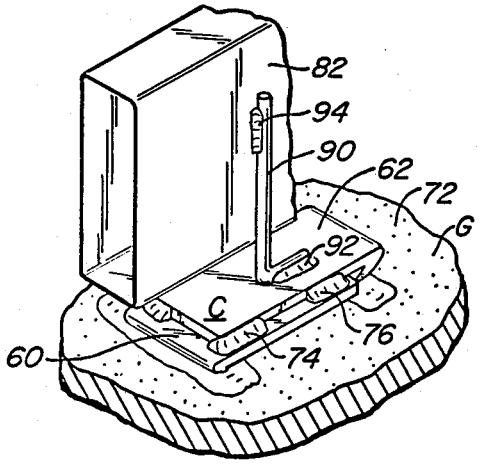
FIG. 3E is a perspective view detail of a clamp with a supporting rod extending from the clamp for holding the panel in spaced apart relation towards and away from a building.
Figure 3D:
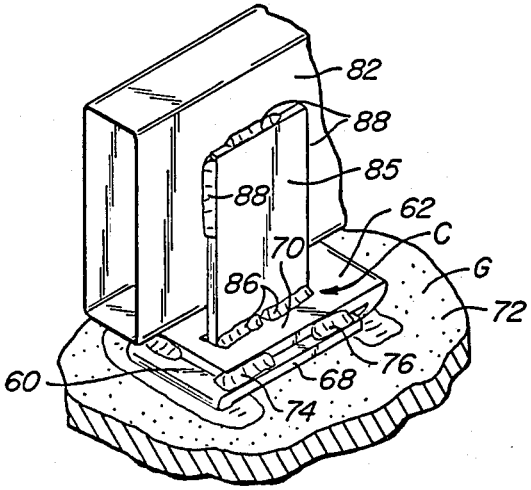
FIG. 3D is a perspective detail of the clamp penetrating into the stone here shown with a butt welded plate for support from a frame to provide maximum shear loading of the clamp.
Figure 4:
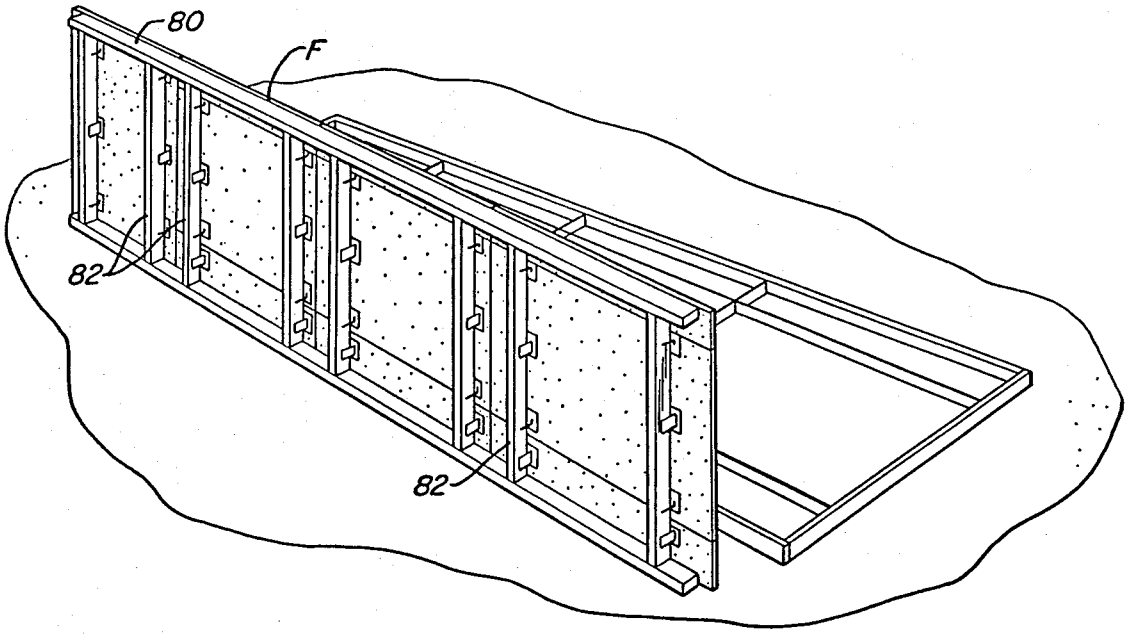
FIG. 4 is a perspective view from the interior side of a frame being lifted away from the jig of FIG. 1 taking with it the panels in their desired supported relation.

Referring to FIG. 4, a frame F including horizontal members 80 and vertical members 82 is shown overlying the jig FIG. 1. The frame F is shown partially lifted away taking with it the respective panel sections. Referring back to FIGS. 3D and 3E, the types of connections between the respective vertical members 82 and the clamps of this invention can be illustrated.

Referring to FIG. 3D, a connection similar to those desired in points 12 of FIG. 1 is illustrated. A plate 85 is clamped typically to the vertical member 82 and juxtaposed to the backing sections 70 of the disclosed clamp. Thereafter, it is butt welded first to the clamp backing section 70 and thereafter to the vertical member 82 at butt welds 86 on the clamp and 88 on vertical member 82.

It should be apparent that precise positioning of the clamp with respect to the frame member 82 has not been required. Rather so long as the plate 85 can see any portion of the clamp back 70, placement can occur.

It will likewise be noted that welds 88 are distant from the welds 86 to the clamp. This preferred deposition is made so that the mounted panel can undergo thermal expansion excursion.

Plate 85 is typically aligned in the plane of loading on panel G by gravity. Similarly, the plate 85 is typically normally disposed to the plane formed by the respective cuts 52, 54. This alignment premits maximum shear support.

Referring to FIG. 3E, the clamp is shown with a lateral support connection only. In this case, a ⅜-inch rod 90 mounts at one end at weld 92 to the back of plate 70. At the opposite end at weld 94, the rod mounts to vertical frame member 82. Again, welds 92, 94 are spaced apart to permit maximum thermal expansion excursion of the granite G relative to the vertical frame member 82.

The reader can understand by viewing the respective clamp configuration that welding is the preferred form of attachment. It will be understood that normally many stones when worked to high heat become frangible. Indeed, this is especially true of some marbles. Here, however, the clamp section is in spaced apart relation from the back of the panel. Typically, the ⅛-inch gap between the panel back 72 and the bottom surface of backing 68 is sufficient to prevent the heat of radiation from appreciably damaging the panel.

Additionally, heat conduction cannot damage the panel at or near the vicinity of the slots 52, 54. Again, the heat must be conducted a sufficient distance from the point of welding. Here, however, the clamp sections 60, 62 are elongate from their respective clamp portions 64, 66 to their respective backs 68, 70. Heat cannot conduct efficiently along the backs 68, 70 to the clamp portions 64, 66. Accordingly, neither the stone nor the epoxy is appreciably effected by the welding which occurs.

It will also be appreciated that the entirety of the panel is constructed without any curing time being required. Consequently, the same jig in the same fabricating area can be rapidly used over and over again. Rapid prefabrication of stone panels occurs. A cost effective and efficient process of manufacturing panels is disclosed.

We have tested the clamps here shown to destruction. These tests demonstrate that relatively large areas of stone must break away from the panels before the panels become separated from the clamps. Consequently, the shear cone or shear profile provided by this clamp is greatly enlarged over that of rod connection observed in the prior art.

What is claimed is:

1. In combination, a stone panel having an exterior exposed weather surface portion and an interior exposed mounting surface;

first and second spaced apart planar and arcuate cuts in said stone panel, said cuts commencing at the interior surface of said panel and extending to and towards but not through the exterior portion of said panel, said cuts each being made along oppositely inclined planes with respect to said stone panel and not extending to the side edges of said panel;

first and second clamp sections, each clamp section including a clamp portion, a back and a bend therebetween, the clamp portion of the first clamp section penetrating the first of said cuts, the clamp portion of the second clamp section penetrating the second of said cuts;

each said back spanning into engagement and juxtaposition with the other back, said clamp portion being bent with respect to said back to permit entry of said clamp portion in said cuts while said backs are placed in engagement and juxtaposition one with another and to permit movement of said back portions relative to one another during insertion into said cuts; each said back being spaced at least about one-eighth inch from said interior mounting surface, and means for engaging juxtaposed backs together to lock said clamp sections to said panel.

2. The invention of claim 1 and wherein said slots and clamp portions are angularly inclined towards one another.

3. The invention of claim 2 wherein the backs of said first and second clamp sections are welded one to another.

4. The invention of claim 1 and wherein said cuts in said panel have an arcuate profile and said clamp portions have a corresponding arcuate profile for engagement with said cuts.

* * * * *